US012551818B2

(12) United States Patent
Suprise

(10) Patent No.: US 12,551,818 B2
(45) Date of Patent: Feb. 17, 2026

(54) FORCED AIR FOG CHILLER

(71) Applicant: Jared Ryan Suprise, South Salt Lake, UT (US)

(72) Inventor: Jared Ryan Suprise, South Salt Lake, UT (US)

( * ) Notice: Subject to any disclaimer, the term of this patent is extended or adjusted under 35 U.S.C. 154(b) by 180 days.

(21) Appl. No.: 18/379,460

(22) Filed: Oct. 12, 2023

(65) Prior Publication Data

US 2025/0121298 A1 Apr. 17, 2025

(51) Int. Cl.
*A63J 5/02* (2006.01)
*F41H 9/06* (2006.01)

(52) U.S. Cl.
CPC ..... *A63J 5/025* (2013.01); *F41H 9/06* (2013.01)

(58) Field of Classification Search
CPC ..... A63J 5/025; F41H 9/06
See application file for complete search history.

(56) References Cited

U.S. PATENT DOCUMENTS

2003/0230109 A1* 12/2003 Link ..... B60H 1/3235 62/423
2004/0060318 A1 4/2004 Bieberich et al.
2007/0000277 A1* 1/2007 Bratcher ..... F24F 5/0017 62/421
2018/0347880 A1 12/2018 Jeong et al.

FOREIGN PATENT DOCUMENTS

JP H09196534 A * 7/1997 ..... F25B 2321/0251

OTHER PUBLICATIONS

International Search Report and Written Opinion received for PCT Application No. PCT/US2024/051193 filed Oct. 14, 2024, 9 pages.

* cited by examiner

*Primary Examiner* — Emmanuel E Duke
(74) *Attorney, Agent, or Firm* — Workman Nydegger

(57) ABSTRACT

A vapor chiller. The vapor chiller includes a chiller vessel configured to store a cooled substance. The chiller vessel includes a plurality of chambers. Each chamber in the plurality of chambers is configured to concentrate the cooled substance at a bottom of the chamber. The vapor chiller further includes a fan coupled to the chiller vessel. The fan is configured to direct vapor through the chiller vessel across the cooled substance in the bottoms of the chambers.

20 Claims, 10 Drawing Sheets

FORCED AIR FOG CHILLER

BACKGROUND

Background and Relevant Art

Fog machines are devices that emit a dense vapor used to simulate fog or smoke. Typically fog machines are used for entertainment and decorative purposes. For example, fog machines may be used to create fog effects for concerts, plays, haunted houses, Halloween displays, etc.

One challenge that exists with fog machines relates to issues with creating a realistic fog effect in view of the fact that the vapor tends to rise from the ground more quickly than actual fog would rise from the ground. This can cause the vapor to be thinner than desired and to be at a height that is higher than desired. One method that has been used to overcome this is to not use a fog machine at all, but rather to use sublimating dry ice to create a fog effect. However, dry ice is expensive, is difficult to handle because of extreme cold temperatures, and creates an asphyxiation hazard if used in confined spaces.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

One embodiment illustrated herein includes a vapor chiller. The vapor chiller includes a chiller vessel configured to store a cooled substance. The chiller vessel includes a plurality of chambers. Each chamber in the plurality of chambers is configured to concentrate the cooled substance at a bottom of the chamber. The vapor chiller further includes a fan coupled to the chiller vessel. The fan is configured to direct vapor through the chiller vessel across the cooled substance in the bottoms of the chambers.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features can be obtained, a more particular description of the subject matter briefly described above will be rendered by reference to specific embodiments which are illustrated in the appended drawings. Understanding that these drawings depict only typical embodiments and are not therefore to be considered to be limiting in scope, embodiments will be described and explained with additional specificity and detail through the use of the accompanying drawings in which.

DETAILED DESCRIPTION

Embodiments illustrated herein relate to a vapor chiller configured cool vapors from fog machines. In particular, the vapor chiller is configured to store a cooled substance (such as ice). The chiller vessel includes a plurality of chambers. Each of the chambers in the plurality of chambers is configured to concentrate the cooled substance at a bottom of the chamber. The vapor chiller further comprises a fan coupled to the chiller vessel. The fan directs vapor through the chiller vessel across the cooled substance in the bottoms of the chambers.

Figure 1:
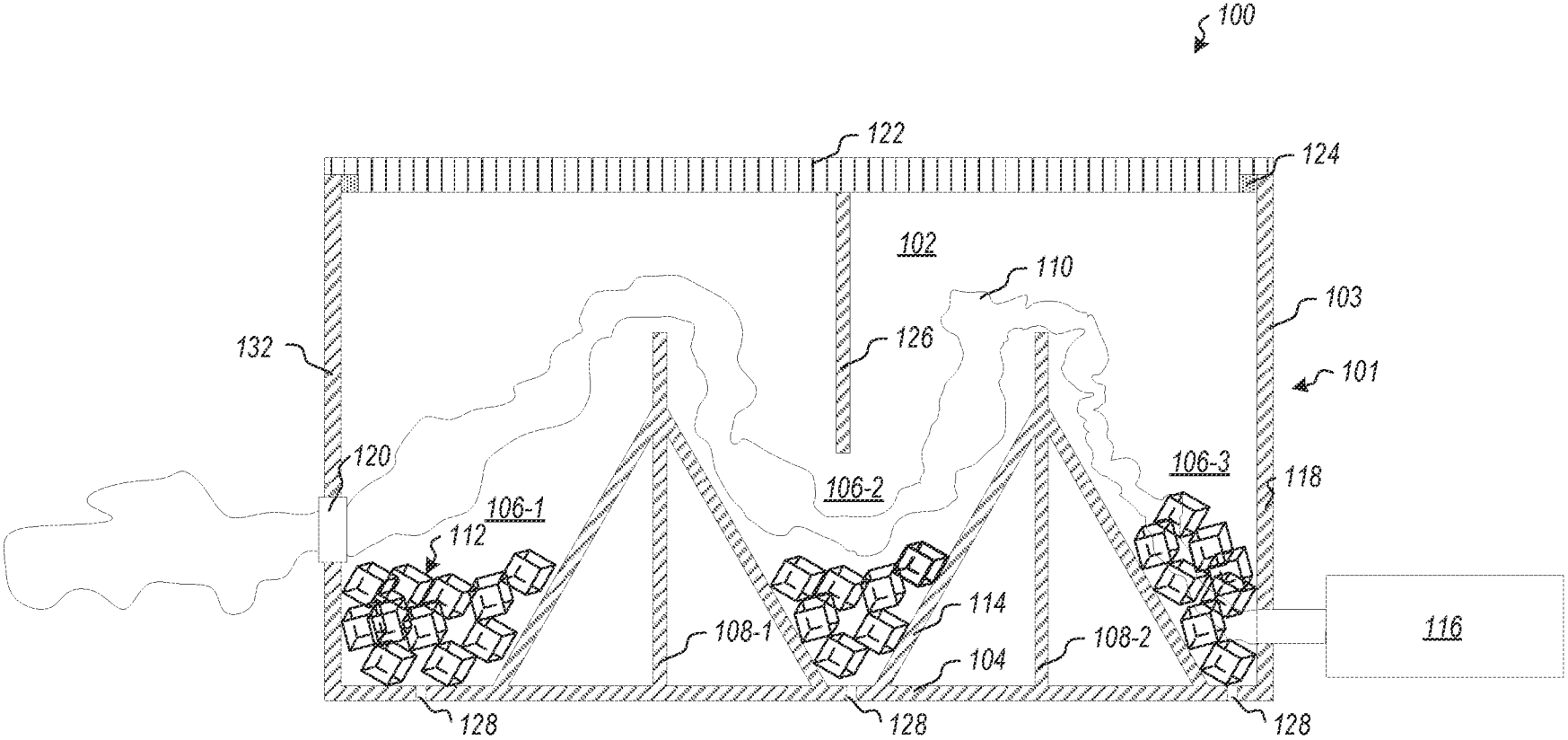
FIG. 1 illustrates a cross-section side view of a vapor chiller.
Figure 2:
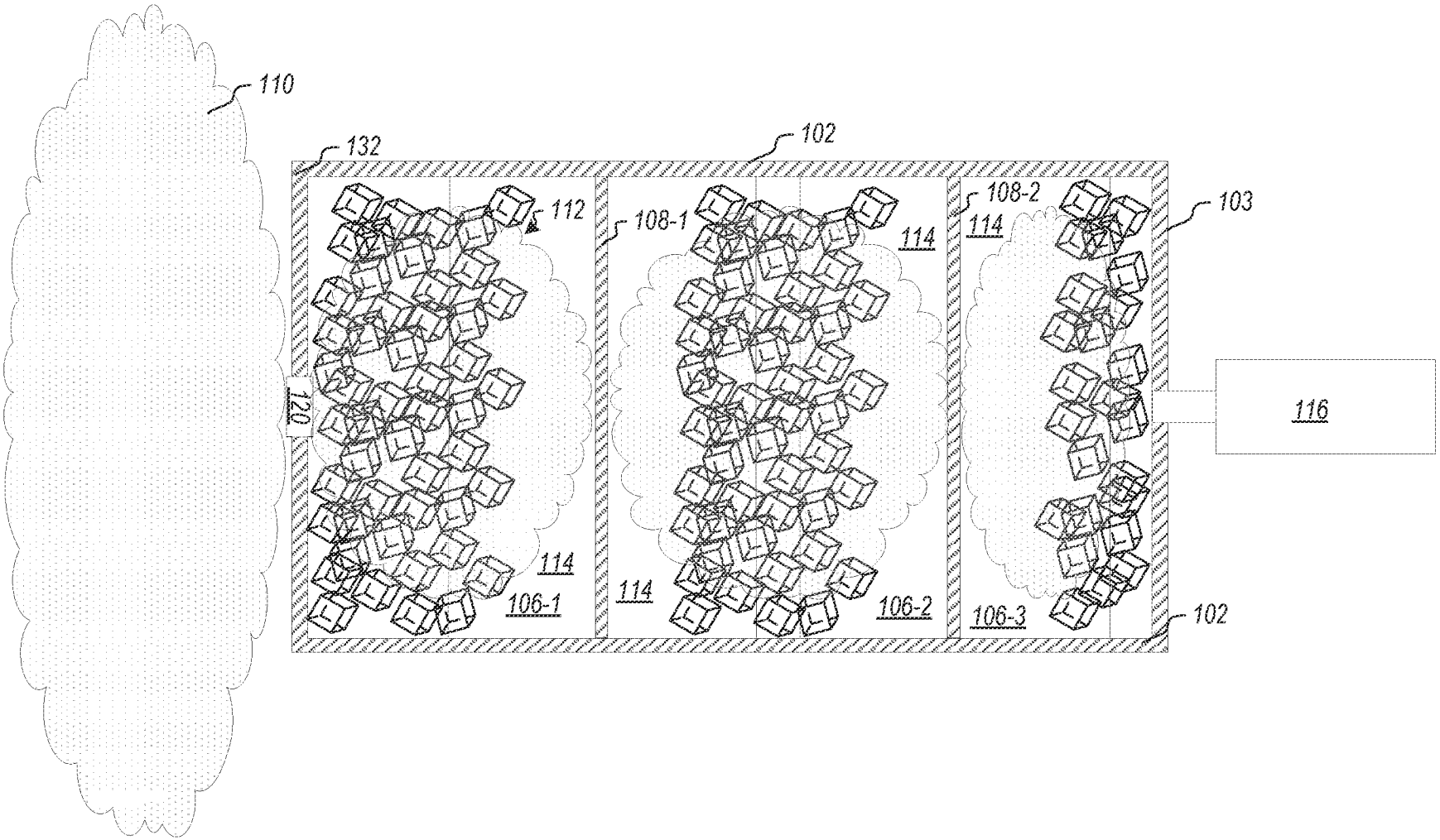
FIG. 2 illustrates a top view of a vapor chiller vessel of the vapor chiller.

An example embodiment is illustrated in FIGS. 1 and 2. FIG. 1 illustrates a cross-section, side view of a vapor chiller 100 and FIG. 2 illustrates a top view of the vapor chiller 100. These views show the structure and internal components of the vapor chiller 100. The vapor chiller 100 includes a chiller vessel having side walls 102, back wall 103, front wall 132 and a bottom 104. In some embodiments, the side walls 102, back wall 103, front wall 132 and bottom 104 are constructed from rigid foam boards so as to provide insulation functionality.

The vapor chiller vessel 101 includes a plurality of interconnected chambers 106-1, 106-2, and 106-3. While three chambers are shown in the example of FIG. 1, it should be appreciated that in other embodiments more or fewer chambers may be implemented. The chambers are formed by using baffles 108-1 and 108-2 between the chambers. The baffles 108-1 and 108-2 may be formed from rigid foam boards or other suitable materials. The baffles 108-1 and 108-2 are of a size, shape, and configuration to separate the chambers while still allowing vapor 110 to pass between the chambers 106-1, 106-2, and 106-3.

Each of the chambers is configured in size and shape to concentrate a cooled substance 112 at the bottom of the chamber. In some embodiments, the cooled substance 112 may be ice. Alternatively, or additionally, the cooled substance may be dry ice, a mixture of water, ice, and salt (to facilitate cooling below the normal freezing temperature of water), or other cooled substances. In the example illustrated in FIG. 1, the chambers have angled walls 114 to facilitate concentration of the cooled substance 112 at the bottom of the chambers. In some embodiments, the walls 114 are formed of rigid foam boards or other suitable materials.

In the example illustrated in FIG. 1, a fog machine 116 is coupled to the vapor chiller 100 through an inlet 118. The inlet 118 is an opening in one of the walls of the vapor chiller 100 that allows vapor 110 from the fog machine 116 to be input into the vapor chiller 100.

The vapor chiller 100 further comprises a fan 120. For example, the fan 120 is configured to assist with forcing the vapor 110 through, and out of, the vapor chiller 100. In some embodiments, the fan 120 may be coupled to a controller configured to vary the speed of the fan. Varying the speed of the fan can be used to control how thick the vapor is that is output from the vapor chiller 100. Slower speeds can be used to output a thicker vapor, while faster speeds can be used to output a thinner vapor.

Figure 3:
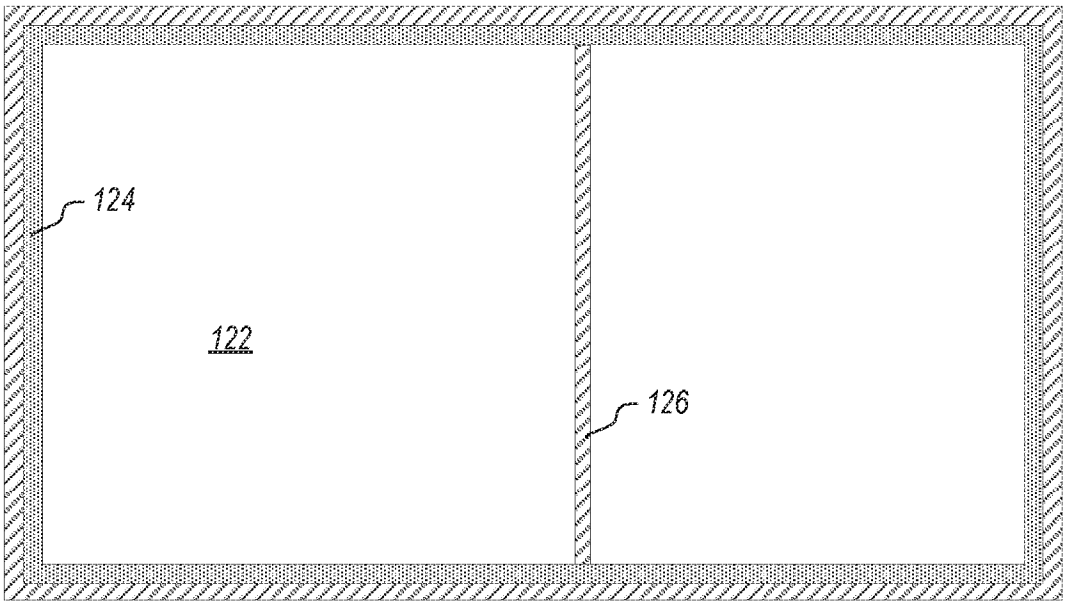
FIG. 3 illustrates a bottom view of a lid for the vapor chiller.

With reference now to FIGS. 1, 2, and 3, the vapor chiller 100, in the example illustrated, further comprises a lid 122. The lid 122 is configured to cover the chambers 106-1, 106-2, and 106-3. In some embodiments, the lid 122 is constructed of a rigid foam board or other suitable material. This may be done to help insulate the vapor chiller 100. In some embodiments, the lid 122 may have a gasket 124 that helps to further insulate and seal the vapor chiller 100.

The lid 122, in some embodiments, further comprises a baffle 126. The baffle 126 is configured in size and shape to extend into one or more of the chambers in a fashion that forces vapor towards the cooled substance 112.

In some embodiments, the vapor chiller 100 includes one or more drains 128. The drains may be included to allow for draining the cooled substance 112 when in liquid form whether due to melting or otherwise.

Figure 4:
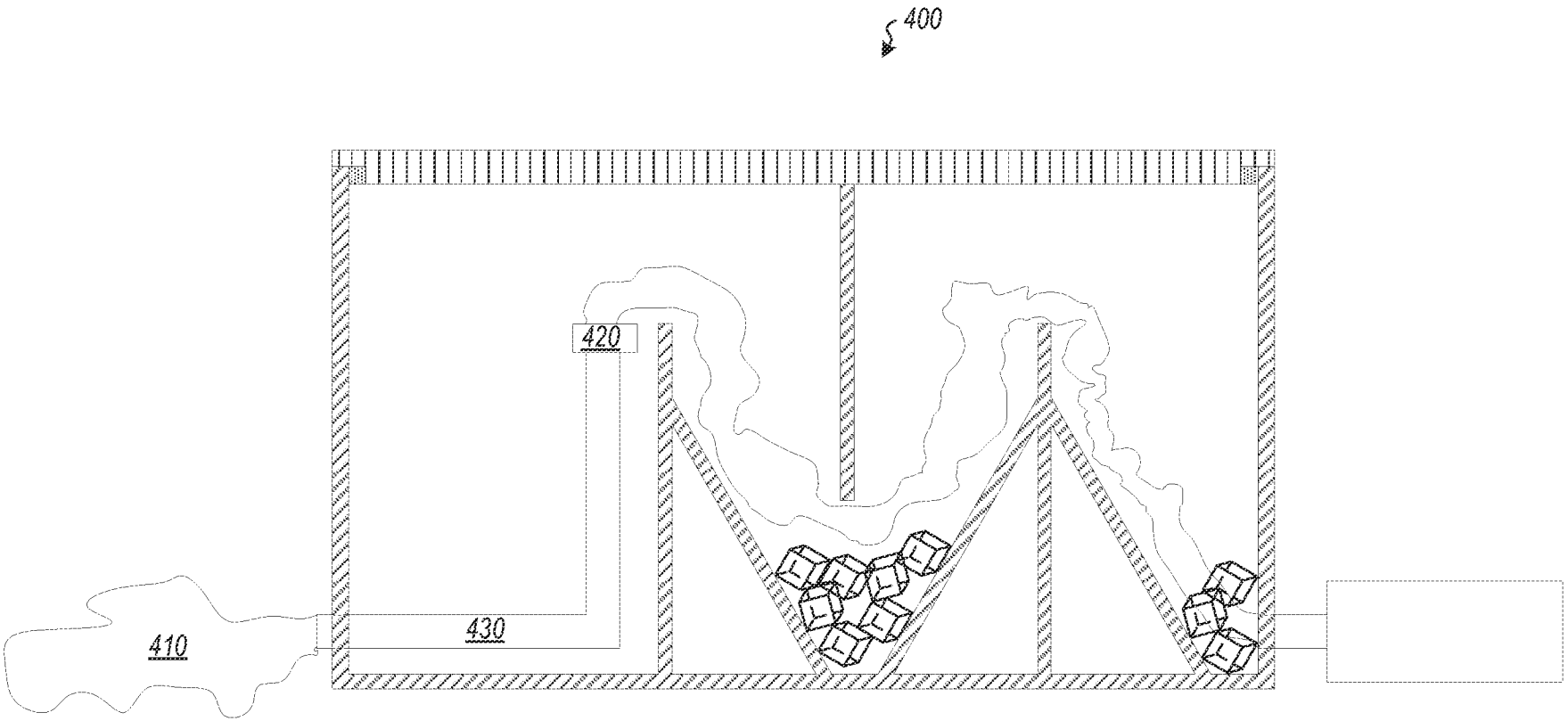
FIG. 4 illustrates a first alternate vapor chiller design.

Other configurations may be implemented. For example, FIG. 4 illustrates a side, cross-section view of an example of a vapor chiller 400 having an internal fan 420 and piping 430 configured to route cooled vapor 410 within the vapor chiller 400 and out of the vapor chiller 400. In the example illustrated in FIG. 4, this can be performed to cause the vapor to be at lower height when exiting the vapor chiller 400.

Figure 5:
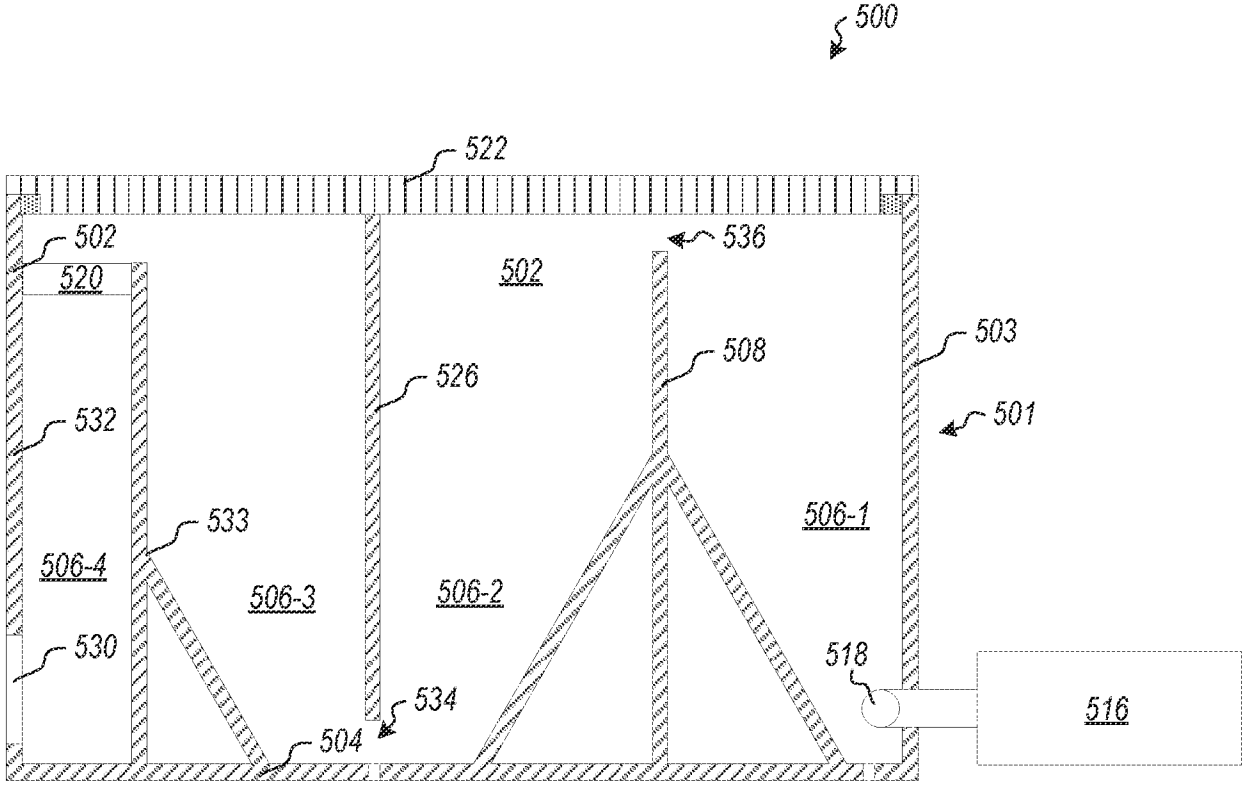
FIG. 5 illustrates a cross-section side view of a second alternate design for a vapor chiller.
Figure 6:
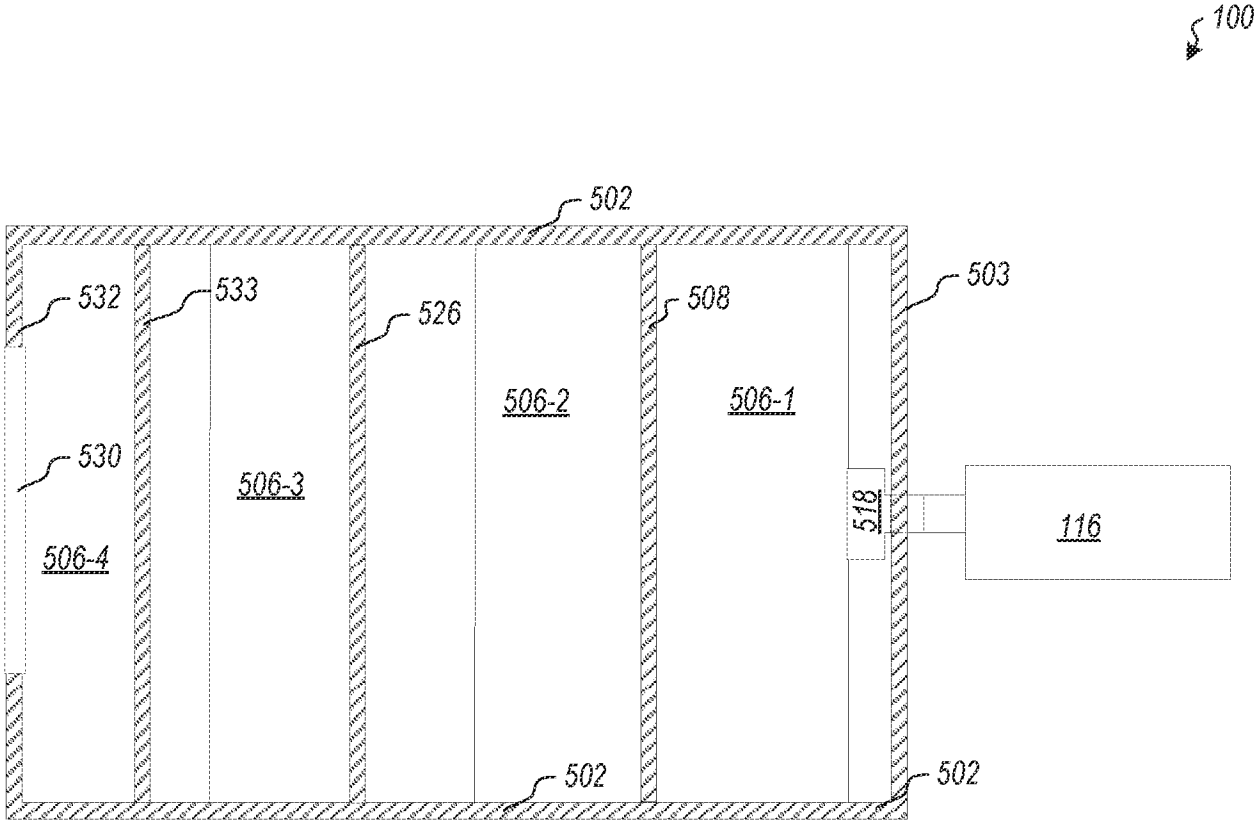
FIG. 6 illustrates a top view of a second alternate design for a vapor chiller vessel of the second alternate design of a vapor chiller.

FIGS. 5, 6, 7, and 8 illustrate yet another example of an alternative vapor chiller 500 design. FIG. 5 illustrates a illustrates a cross-section, side view of a vapor chiller 500 and FIG. 6 illustrates a top view of the vapor chiller 500. These views show the structure and internal components of the vapor chiller 500. The vapor chiller 500 includes a chiller vessel 501 having side walls 502, back wall 503, front wall 530 and a bottom 504. In some embodiments, the side walls 502, back wall 503, and bottom 504 are constructed from rigid foam boards so as to provide insulation functionality.

The vapor chiller vessel 501 includes a plurality of interconnected chambers 506-1, 506-2, and 506-3. While three chambers are shown in the example of FIG. 5, it should be appreciated that in other embodiments more or fewer chambers may be implemented. The chambers are formed by using baffles 508 and 526 between the chambers. The baffles 508 and 526 may be formed from rigid foam boards or other suitable materials. The baffles 508 and 526 are of a size, shape, and configuration to separate the chambers while still allowing vapor to pass between the chambers 506-1, 506-2, and 506-3.

Each of the chambers 506-1, 506-2, and 506-3 is configured in size and shape to concentrate a cooled substance at the bottom of the chamber. In FIG. 5, the chambers 506-1, 506-2, and 506-3 have angled walls to facilitate concentration of the cooled substance at the bottom of the chambers 506-1, 506-2, and 506-3. In some embodiments, the walls are formed of rigid foam boards or other suitable materials.

In the example illustrated in FIG. 5, a fog machine 516 is coupled to the vapor chiller 500 through an inlet 518. The inlet 518 is an opening in one of the walls of the vapor chiller 500 that allows vapor from the fog machine 516 to be input into the vapor chiller 500. In some embodiments, the inlet 518 may be formed, at least partially, from a PVC T-connector. This allows fog to be distributed laterally from the center of the inlet 518. Note that other embodiments may also use a PVC T-connector or other configuration configured to distribute vapor in a desired fashion. In some embodiments, the inlet 518 may be configured to distribute, such as by having holes or other openings laterally along the inlet, vapor along the inlet 518 rather than just at an end or ends of the inlet 518.

The vapor chiller 500 further comprises a fan 520 between a vapor chamber 506-4 and the chamber 506-3. The vapor chamber 506-4 is formed by including an internal wall structure 533. The fan 520 is configured to assist with forcing the vapor through, and out of, the vapor chiller 500, through a vent 530 in the front wall 532. In some embodiments, the fan 520 may be coupled to a controller configured to vary the speed of the fan. Varying the speed of the fan can be used to control how thick the vapor is that is output from the vapor chiller 500. Slower speeds can be used to output a thicker vapor, while faster speeds can be used to output a thinner vapor.

Figure 7:
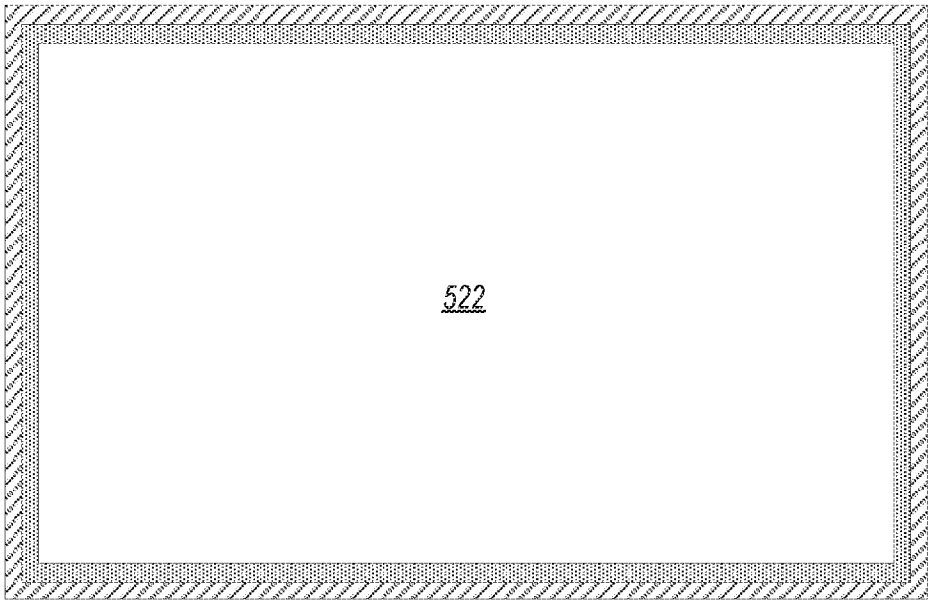
FIG. 7 illustrates a bottom view of a lid for the second alternate design for a vapor chiller.
Figure 8:
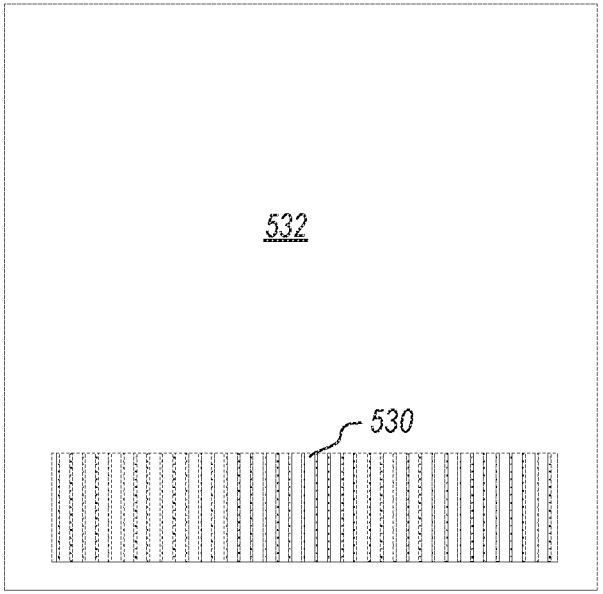
FIG. 8 illustrates a front view of the second alternate design for a vapor chiller.

With reference now to FIGS. 5 and 7, the vapor chiller 500, in the example illustrated, further comprises a lid 522. The lid 522 is configured to cover the chambers 506-1, 506-2, 506-3, and 506-4. In some embodiments, the lid 522 is constructed of a rigid foam board or other suitable material. This may be done to help insulate the vapor chiller 500. In some embodiments, the lid 522 may have a gasket that helps to further insulate and seal the vapor chiller 500.

Note that while in previously illustrated embodiments, the lid 122 included a baffle 126, in the illustrated example, the baffle 526 is part of the vapor chiller vessel 501. The baffle 526 is configured in size and shape to force vapor towards the cooled substance. Note that in this example, the vapor chiller vessel 501 comprises a space 534 between the baffle 526 and the bottom 504. For example, the space may be 1 inch in height. Similarly, a space 536 may be implemented between the baffle 508 and the bottom of the lid 522. The space 536 may be 1 inch in height. Note that other dimensions may be used in other embodiments. The baffle 526 may be coupled to the sides 502 to cause the baffle 526 to be tight to the lid 522 when the lid 522 is installed on the vapor chiller vessel 501.

The following discussion now refers to a number of methods and method acts that may be performed. Although the method acts may be discussed in a certain order or illustrated in a flow chart as occurring in a particular order, no particular ordering is required unless specifically stated, or required because an act is dependent on another act being completed prior to the act being performed.

Figure 9:
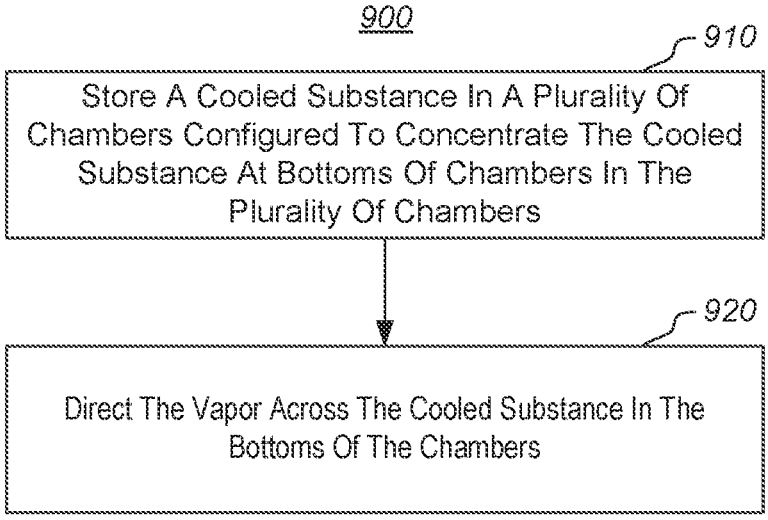
FIG. 9 illustrates a method of chilling vapor.

Referring now to FIG. 9, a method 900 is illustrated. The method includes acts of chilling vapor. The method includes storing a cooled substance in a plurality of chambers configured to concentrate the cooled substance at bottoms of chambers in the plurality of chambers (act 910).

The method further includes directing the vapor across the cooled substance in the bottoms of the chambers (act 920).

The method 900 may further include separating the chambers using one or more baffles.

The method 900 may further include covering the one or more chambers. In some embodiments, covering the one or more chambers includes covering the one or more chambers with a lid that comprises one or more baffles coupled to the lid and configured in size and shape to extend into one or more of the chambers in a fashion that forces vapor towards the cooled substance. In some embodiments, covering the one or more chambers comprises covering the one or more chambers with a lid that comprises a gasket coupled to the lid and configured in size and shape to seal the lid to a chiller vessel having the chambers.

The method 900 may be practiced where the chambers are constructed of rigid foam board.

The method 900 may be practiced where the cooled substance comprises ice.

The method 900 may further include draining portions of the cooled substance that have melted out of a bottom of a chamber.

Figure 10:
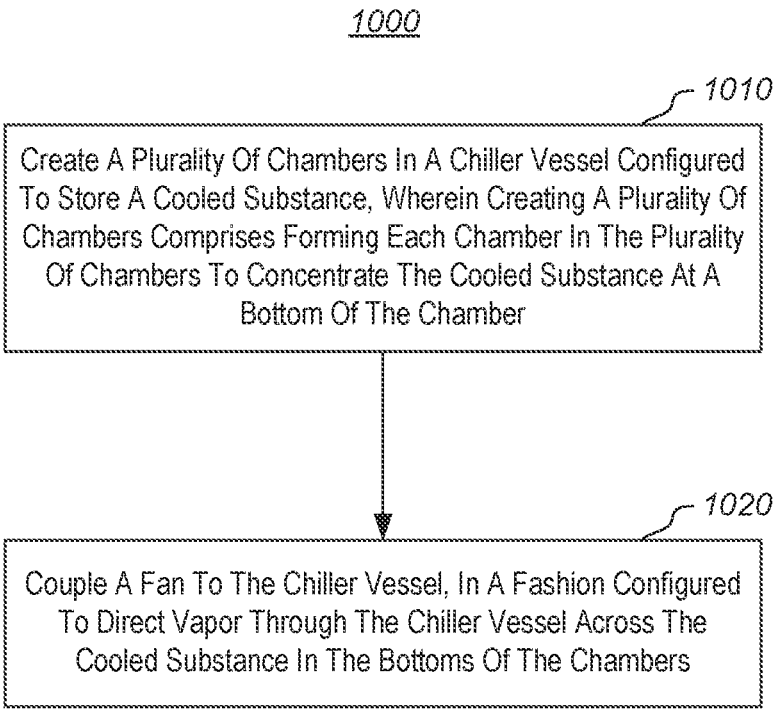
FIG. 10 illustrates a method of manufacturing a vapor chiller.

Referring now to FIG. 10, a method of manufacturing a vapor chiller is shown. The method 1000 includes creating a plurality of chambers in a chiller vessel configured to store a cooled substance, wherein creating a plurality of chambers comprises forming each chamber in the plurality of chambers to concentrate the cooled substance at a bottom of the chamber (act 1010).

The method 1000 further includes coupling a fan to the chiller vessel, in a fashion configured to direct vapor through the chiller vessel across the cooled substance in the bottoms of the chambers (1020).

The method 1000 may further include separating each of the chambers from each other by one using or more baffles.

The method 1000 may further include constructing a lid configured to cover the one or more chambers. This may include coupling one or more baffles to the lid configured in size and shape to extend into one or more of the chambers in a fashion that forces vapor towards the cooled substance.

The method 1000 may further include comprising coupling a gasket to the lid, wherein the gasket configured in size and shape to seal the lid to the chiller vessel.

The present invention may be embodied in other specific forms without departing from its characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A vapor chiller comprising:

a chiller vessel configured to store a cooled substance, wherein the chiller vessel comprises a plurality of chambers, each chamber in the plurality of chambers is configured to concentrate the cooled substance at a bottom of the chamber;

a fan coupled to the chiller vessel, and configured to direct vapor through the chiller vessel across the cooled substance in the bottoms of the chambers; and wherein the chiller vessel is configured to direct vapor in an upward direction in a first chamber, subsequently downward into a second chamber, and out of the chiller vessel more proximate a bottom of the chiller vessel than a top of the chiller vessel.

2. The vapor chiller of claim 1, wherein each of the chambers are separated by one or more baffles.

3. The vapor chiller of claim 1, further comprising a lid configured to cover the one or more chambers.

4. The vapor chiller of claim 3, further comprising one or more baffles coupled to the lid and configured in size and shape to extend into one or more of the chambers in a fashion that forces vapor towards the cooled substance.

5. The vapor chiller of claim 3, further comprising a gasket coupled to the lid and configured in size and shape to seal the lid to the chiller vessel.

6. The vapor chiller of claim 1, wherein the chiller vessel is constructed of rigid foam board.

7. The vapor chiller of claim 1, wherein the cooled substance comprises ice.

8. The vapor chiller of claim 1, wherein the chambers in the plurality of chambers comprise one or more drains configured to drain portions of the cooled substance that have melted.

9. The vapor chiller of claim 1, further wherein the chiller vessel is configured to direct vapor upward from the second chamber and downward into a third chamber having an outlet proximate the bottom of the chiller vessel the third chamber configured to be free of the cooled substance to allow the vapor to exit the chiller vessel proximate the bottom of the chiller vessel from a chamber not having the cooled substance.

10. The vapor chiller of claim 1, wherein at least one of the chambers has two sloped walls.

11. A method of chilling vapor, the method comprising:

storing a cooled substance in a plurality of chambers of a chiller vessel configured to concentrate the cooled substance at bottoms of chambers in the plurality of chambers;

directing the vapor across the cooled substance in the bottoms of the chambers by:

directing vapor in an upward direction in a first chamber, subsequently downward into a second chamber, and out of the chiller vessel more proximate a bottom of the chiller vessel than a top of the chiller vessel.

12. The method of claim 11, further comprising separating the chambers using one or more baffles.

13. The method of claim 11, further comprising covering the one or more chambers.

14. The method of claim 13, wherein covering the one or more chambers comprises covering the one or more chambers with a lid that comprises one or more baffles coupled to the lid and configured in size and shape to extend into one or more of the chambers in a fashion that forces vapor towards the cooled substance.

15. The method of claim 13, wherein covering the one or more chambers comprises covering the one or more chambers with a lid that comprises a gasket coupled to the lid and configured in size and shape to seal the lid to a chiller vessel having the chambers.

16. The method of claim 13, wherein the chambers are constructed of rigid foam board.

17. The method of claim 11, further comprising directing vapor upward from the second chamber and downward into a third chamber having an outlet proximate the bottom of the chiller vessel, the third chamber being free of the cooled substance to allow the vapor to exit the chiller vessel proximate the bottom of the chiller vessel from a chamber not having the cooled substance.

18. A method of manufacturing a vapor chiller, the method comprising:

creating a plurality of chambers in a chiller vessel configured to store a cooled substance, wherein creating the plurality of chambers comprises forming each chamber in the plurality of chambers to concentrate the cooled substance at a bottom of the chamber; and coupling a fan to the chiller vessel, in a fashion configured to direct vapor through the chiller vessel across the cooled substance in the bottoms of the chambers to configure the chiller vessel to direct vapor in an upward direction in a first chamber, subsequently downward into a second chamber, and out of the chiller vessel more proximate a bottom of the chiller vessel than a top of the chiller vessel.

19. The method of claim 18 further comprising separating each of the chambers from each other by one using or more baffles.

20. The method of claim 18 further comprising constructing a lid configured to cover the one or more chambers, including constructing one or more baffles coupled to the lid and configured in size and shape to extend into one or more of the chambers in a fashion that forces vapor towards the cooled substance.

* * * * *